US010550772B1

(12) United States Patent
Khan et al.

(10) Patent No.: US 10,550,772 B1
(45) Date of Patent: Feb. 4, 2020

(54) CAMSHAFT ASSEMBLY AND METHOD OF OPERATING THE SAME

(71) Applicant: GM GLOBAL TECHNOLOGY OPERATIONS LLC, Detroit, MI (US)

(72) Inventors: Maqsood Rizwan Ali Khan, Rochester Hills, MI (US); William F. Miller, III, Beverly Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/168,246

(22) Filed: Oct. 23, 2018

(51) Int. Cl.
*F02D 13/04* (2006.01)
*F01L 1/047* (2006.01)

(52) U.S. Cl.
CPC ..... *F02D 13/04* (2013.01); *F01L 1/047* (2013.01)

(58) Field of Classification Search
CPC ..... F01L 2001/0473; F01L 1/053; F01L 1/08; F01L 1/46; F01L 2013/0052; F01L 13/06; F01L 2013/101; F01L 2760/00; F01L 2760/003; F01L 2820/031; F02D 13/04
USPC ..... 123/90.17, 90.18, 90.27, 90.6
See application file for complete search history.

(56) References Cited

U.S. PATENT DOCUMENTS

2017/0241305 A1* 8/2017 Xi ..... F01L 13/06
2017/0268391 A1 9/2017 Hayden
2018/0142585 A1* 5/2018 Lahr ..... F01L 13/065
2019/0242278 A1* 8/2019 Zurk ..... F01L 1/08

* cited by examiner

*Primary Examiner* — Jorge L Leon, Jr.
(74) *Attorney, Agent, or Firm* — Reising Ethington, P.C.

(57) ABSTRACT

A camshaft assembly for an internal combustion engine of a vehicle and method of operating the camshaft assembly to enhance engine braking performance through selective activation of a cam lobe having a brake gas recirculation contour. The camshaft assembly comprises an exhaust camshaft and a lobe pack on the exhaust camshaft, with the lobe pack including a plurality of cam lobes. At least one cam lobe of the plurality of cam lobes includes a brake gas recirculation cam contour having an exhaust stroke projection and a combustion stroke projection. The method switches to the cam lobe including the brake gas recirculation profile when certain criteria indicate that an engine braking mode is to be activated.

18 Claims, 4 Drawing Sheets

10

140
134
12
138
136
118
22
20
120
110
128
112
114
122
132
130
126
124
116

CAMSHAFT ASSEMBLY AND METHOD OF OPERATING THE SAME

INTRODUCTION

The field of technology generally relates to camshaft assemblies for internal combustion engines and, more particularly, to multi-step cams for camshaft assemblies to enhance braking.

For some vehicles, such as larger load trucks with diesel internal combustion engines, slowing the engine's crankshaft can help increase vehicle stopping power. Compression release brakes or the like can assist in this functionality, but the structure of such braking systems can be complex and may not be independently controllable. Controlling engine braking performance can help minimize stress on the engine, particularly for vehicles with higher towing capacity.

SUMMARY

According to one embodiment, there is provided a camshaft assembly for an internal combustion engine, comprising an exhaust camshaft; an exhaust valve lifter; and a lobe pack including a plurality of cam lobes. The lobe pack is configured on the exhaust camshaft such that one or more cam lobes of the plurality of cam lobes can selectively activate the exhaust valve lifter. At least one cam lobe of the plurality of cam lobes includes a brake gas recirculation cam contour having an exhaust stroke projection and a combustion stroke projection. The combustion stroke projection is configured to increase exhaust outtake during a combustion stroke of the internal combustion engine.

According to various embodiments, this assembly may further include any one of the following features or any technically-feasible combination of these features:

- the lobe pack is a two-step lobe pack having two cam lobes, each cam lobe having a different cam contour;
- an exhaust valve lift profile for the brake gas recirculation cam contour includes two more exhaust lifts than the exhaust valve lift profile for the cam lobe without the brake gas recirculation cam contour;
- the lobe pack is a three-step lobe pack having three cam lobes, each cam lobe having a different cam contour;
- a second lobe pack including a plurality of cam lobes;
- the plurality of cam lobes of the second lobe pack includes a cam lobe having a brake gas recirculation cam contour;
- the plurality of cam lobes of the second lobe pack includes cam lobes without a brake gas recirculation cam contour;
- the combustion stroke projection and the exhaust stroke projection have different circumferential widths;
- the circumferential width of the combustion stroke projection is one-sixth to one-half, inclusive, of the circumferential width of the exhaust stroke projection;
- the lobe pack is slidably displaceable along the exhaust camshaft via actuation of an electromagnetic actuator; and/or
- the internal combustion engine is diesel-powered.

According to another embodiment, there is provided a method of operating a camshaft assembly for an internal combustion engine, the camshaft assembly comprising an exhaust camshaft and a lobe pack on the exhaust camshaft, with the lobe pack including a plurality of cam lobes. At least one cam lobe of the plurality of cam lobes includes a brake gas recirculation cam contour having an exhaust stroke projection and a combustion stroke projection. The method comprises the steps of: monitoring one or more engine braking parameters; comparing the one or more engine braking parameters to an engine braking speed value; switching to the cam lobe with the brake gas recirculation cam contour when the comparison of the one or more engine braking parameters to the engine braking speed value indicates that an engine braking mode is to be activated; opening an exhaust valve of the internal combustion engine with the exhaust stroke projection during an exhaust stroke of the internal combustion engine; and opening the exhaust valve of the internal combustion engine with the combustion stroke projection during a combustion stroke of the internal combustion engine.

According to various embodiments, this method may further include any one of the following features or any technically-feasible combination of these features:

- the one or more engine braking parameters includes an engine speed and the engine braking speed value is an application specific braking value, and the switching step takes place when the engine speed is greater than the application specific braking value;
- the one or more engine braking parameters further includes a vehicle speed and a cruise control speed, and the switching step takes place when the vehicle speed is greater than the cruise control speed;
- the one or more engine braking parameters includes an engine speed and the engine braking speed value is an application specific exhaust valve reopening value, and the switching step takes place when the engine speed is greater than the application specific exhaust valve reopening value;
- providing an alert to a user of the vehicle before switching to the cam lobe with the brake gas recirculation contour;
- the switching step occurs automatically through use of a controller; and/or
- providing an alert to a user of the vehicle that an engine braking mode is activated.

BRIEF DESCRIPTION OF THE DRAWINGS

Preferred exemplary embodiments will hereinafter be described in conjunction with the appended drawings, wherein like designations denote like elements, and wherein.

DETAILED DESCRIPTION

The assembly and operating method described herein relate to exhaust camshafts that can enhance engine braking performance. A multi-step camshaft assembly can be selectively activated to help improve control of the exhaust valve at particular points, in order to slow the engine's camshaft and increase the vehicle's stopping power. The camshaft assembly includes a cam lobe with a brake gas recirculation cam contour that facilitates the release of exhaust from the combustion chamber during the combustion stroke so that less power is transmitted to the engine's crankshaft. The cam lobe with the brake gas recirculation cam contour may be slidably displaceable along the exhaust camshaft in the multi-step camshaft assembly such that a normal cam lobe can be employed when engine braking is not desired. Use of the cam lobe with the brake gas recirculation cam contour can result in lower stress on the engine during braking while providing similar or improved performance.

Figure 1:
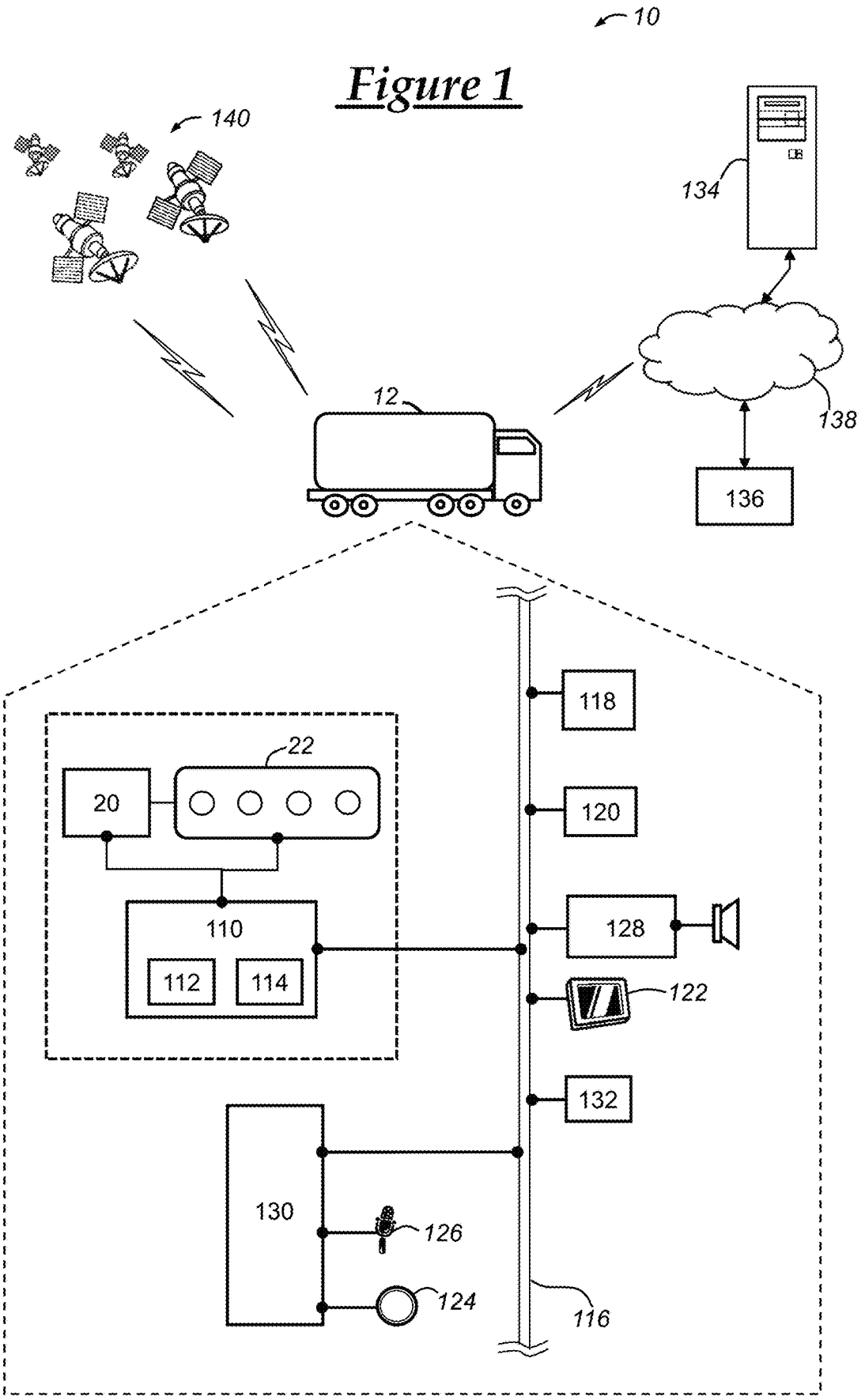
FIG. 1 is a schematic representation of an operating environment and a vehicle having a camshaft assembly that is operable according to various embodiments of the method disclosed herein.

With reference to FIG. 1, there is shown a vehicle operating environment 10 that can be used to implement the method disclosed herein. Operating environment 10 generally includes a vehicle 12 with a camshaft assembly 20 for controlling an internal combustion engine 22. It should be understood that the disclosed assemblies and methods can be used with any number of different systems and is not specifically limited to the operating environment shown here. The following paragraphs provide a brief overview of one such operating environment 10; however, other systems and assemblies not shown here could employ the disclosed methods as well.

Vehicle 12 is depicted in the illustrated embodiment as a semi-truck, but it should be appreciated that any other vehicle including passenger cars, motorcycles, other trucks, sports utility vehicles (SUVs), recreational vehicles (RVs), marine vessels, aircraft, etc., can also be used. In the illustrated embodiment, the vehicle 12 is a diesel-powered truck that primarily uses the internal combustion engine 22 for propulsion; however, in other embodiments, the vehicle 12 can be a hybrid vehicle or use another form of propulsion energy besides diesel. The engine 22 has one or more cylinders with a piston. The piston rotates a crankshaft via volumetric changes in the combustion chamber due to ignition and combustion of an air fuel mixture. The representation of the operating environment 10 and engine 22 is schematic, and accordingly, other features not illustrated may be provided, such as an exhaust gas recirculation (EGR) system, various valves or shafts, etc.

Figures 2, 3:
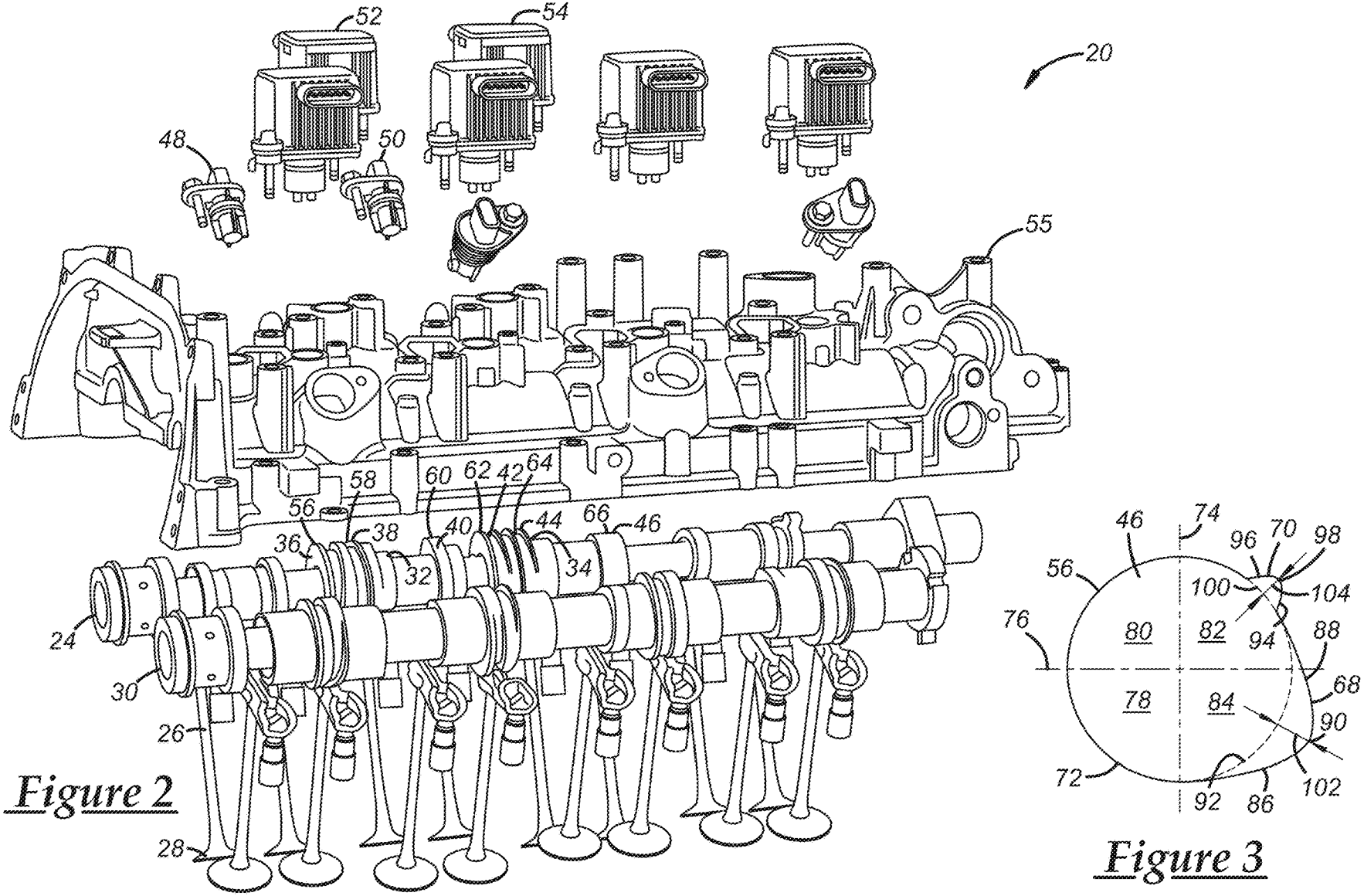
FIG. 2 illustrates the camshaft assembly of FIG. 1.
FIG. 3 illustrates a brake gas recirculation cam contour of a cam lobe of the camshaft assembly of FIGS. 1 and 2.

The camshaft assembly 20 is shown schematically in FIG. 1 and an exploded view of one embodiment of the camshaft assembly is illustrated in FIG. 2. The camshaft assembly 20 includes an exhaust camshaft 24, an exhaust valve lifter 26, and an exhaust valve 28 which generally control exhaust output from the combustion chamber of the engine 22. Only one exhaust valve lifter 26 and exhaust valve 28 are labeled in FIG. 2 for clarity purposes, but it is generally understood that the number of exhaust valve lifters 26 and exhaust valves 28 will correspond to the number of combustion chambers or cylinders in the engine 22. Furthermore, the structure, dimensions, configurations, etc. of the camshaft assembly 20 can vary from what is illustrated in FIG. 2, as such considerations are largely dictated by the needs of the particular engine. The camshaft assembly 20 also includes an intake camshaft 30 which generally controls air intake into the combustion chambers of the engine 22.

Lobe packs 32, 34 are situated on the exhaust camshaft 24 of the camshaft assembly 20 to facilitate variable operation of each of the valve lifters 26. The lobe pack 32 includes a plurality of cam lobes 36, 38, 40, and the lobe pack 34 includes a plurality of cam lobes 42, 44, 46. Each lobe pack 32, 34 is slidably displaceable along the exhaust camshaft 24 via actuation of one or more position actuators 48, 50. The position actuators 48, 50 in the illustrated embodiment are electromagnetic actuators; however, other methods of actuation are certainly possible to facilitate movement of the cam lobes 36-46 and/or the camshaft 24 with respect to the valve lifters 26. One example is detailed in U.S. patent application Ser. No. 15/071,578 filed on Mar. 16, 2016, assigned to the Applicant of the present application, and incorporated by reference in its entirety herein. The electromagnetic position actuators 48, 50 can allow for full onboard diagnostic capability, particularly when used in conjunction with various sensors described below.

The lobe packs 32, 34 in the illustrated embodiment are three-step lobe packs, with each lobe pack having three different cam lobes. In another embodiment, the lobe packs are two-step lobe packs, with each lobe pack having two different cam lobes (e.g., lobe pack 32 only has two cam lobes 36, 38, while the lobe pack 34 has two or more cam lobes). The position of the lobe packs 32, 34 and/or the cam lobes 36-46 may be sensed directly or indirectly via camshaft position sensors 52, 54. As shown in FIG. 2, the intake camshaft 30 may also include various lobe packs, actuators, sensors, etc., and the camshaft assembly 20 may be generally protected by an engine cover 55.

The cam lobes 36-46 can selectively activate the exhaust lifters 26 such that rotation of a cam lobe opens the exhaust valve 28 to allow air or exhaust gases to exit the combustion chamber of the internal combustion engine 22. The cam lobes 36-46 may interact with exhaust lifters 26 directly (e.g., via a mechanical connection through a rocker arm or the like) or indirectly (e.g., via an electro-based connection through a hydraulic pump or the like). Each cam lobe 36-46 has a respective cam lobe contour 56-66. In the illustrated embodiment, the cam lobes 46, 42 have a brake gas recirculation cam contour 56, 62, respectively. The other cam lobes can have different cam contours. For example, cam lobes 38, 44 may have a standard or normal lift cam contour or a high lift cam contour 58, 64. In another example, cam lobe 40 may have a low lift cam contour 60, and in yet another example, cam lobe 46 may have a zero lift cam contour 66. The various combinations of cam contours in each lobe pack may be varied depending on the desired configuration of the camshaft assembly 20.

A cross-section of the cam lobe 46 with the brake gas recirculation cam contour 56 is shown in FIG. 3 (the exhaust camshaft 24 is not shown, but generally extends through the center of the cam lobe 46). The brake gas recirculation cam contour 56 includes an exhaust stroke projection 68 and a separate combustion stroke projection 70 which both extend out from base circle 72. In FIG. 3, the vertical line 74 represents top dead center (TDC) and the horizontal line 76 represents bottom dead center (BDC) such that the cam contour 56 includes an intake stroke area 78, a compression stroke area 80, a combustion stroke area 82, and an exhaust stroke area 84. A normal or standard cam lobe contour, such as the cam lobe contours 58, 64 of cam lobes 38, 44, respectively, includes an exhaust stroke projection 68 which extends out from base circle 72 without the separate combustion stroke projection 70. With the normal or standard cam lobe contour, the exhaust stroke projection 68 causes slight opening of the exhaust valve 28 at the end of the combustion stroke. However, with the brake gas recirculation cam contour 56, the exhaust valve 28 is further opened during the combustion stroke such that less power is transmitted to the crankshaft, thereby slowing the vehicle.

For the brake gas recirculation cam contour 56, the exhaust stroke projection 68 includes projecting walls 86, 88 which meet at an apex 90. The exhaust stroke projection 68 has a circumferential width 92, which is equal to the circumference of the base circle 72 between the intersection of each of the projecting walls 86, 88. The combustion stroke projection 70 is located directly adjacent to the projecting wall 88 of the exhaust stroke projection. The combustion stroke projection 70 includes projecting walls 94, 96 which meet at an apex 98. In an advantageous embodiment, the projecting walls 88, 94 join at the base circle 72. The combustion stroke projection 70 has a circumferential width 100, which is equal to the circumference of the base circle 72 between the intersection of each of the projecting walls 94, 96. Each of the exhaust stroke projection 68 and the combustion stroke projection 70 have a radial height 102, 104, respectively, between the circumference of the base circle 72 and each apex 90, 98.

The size of the combustion stroke projection 70 may vary depending upon a number of factors, such as the size of engine 22, the size of camshaft 24, etc. In some embodiments, the combustion stroke projection 70 and the exhaust stroke projection 68 have equal radial heights 102, 104, but in the illustrated embodiment, the radial height 102 of the exhaust stroke projection 68 is greater than the radial height 104 of the combustion stroke projection 70. Additionally, in the illustrated embodiment, the exhaust stroke projection 68 and the combustion stroke projection 70 have different circumferential widths 92, 100. In some embodiments, the circumferential width 100 of the combustion stroke projection 70 is one-sixth to one-half, inclusive, of the circumferential width 92 of the exhaust stroke projection 68. In the illustrated embodiment, the circumferential width 100 of the combustion stroke projection 70 is about one-fourth of the circumferential width 92 of the exhaust stroke projection 68. The circumferential width 100 of the combustion stroke projection 70 may be sized, in one embodiment, such that the exhaust valve 28 will be open for about one-half to one-fourth (advantageously about one-third) of the end of the combustion stroke. These size differentials can result in improved valve timing and better engine braking performance.

Returning to FIG. 1, the camshaft assembly 20 may be controlled by an engine control unit (ECU) or controller 110. Controller 110 includes an electronic processor 112 and memory 114, and may be used to implement the operating methods described herein. The controller 110 (control unit, control module, etc.) may be an integrated engine controller or it may be a separate controller such as an exhaust or engine braking specific controller. The controller 110 may also be integrated with or otherwise a part of another vehicle system or component, such as a powertrain control module. Accordingly, the controller 110 is not limited to any one particular embodiment or arrangement and may be used by the present method to control one or more aspects of the camshaft assembly 20.

Processor 112 can be any type of device capable of processing electronic instructions including microprocessors, microcontrollers, host processors, controllers, vehicle communication processors, and application specific integrated circuits (ASICs). It can be a dedicated processor used only for the camshaft assembly 112, or it can be shared with other vehicle systems. Processor 112 executes various types of digitally-stored instructions, such as software or firmware programs stored in memory 114, which enable strategic control of the camshaft assembly 20. For instance, processor 112 can execute programs or process data to carry out at least a part of the method discussed herein. Memory 114 may be a temporary powered memory, any non-transitory computer-readable medium, or other type of memory. For example, the memory can be any of a number of different types of RAM (random-access memory, including various types of dynamic RAM (DRAM) and static RAM (SRAM)), ROM (read-only memory), solid-state drives (SSDs) (including other solid-state storage such as solid state hybrid drives (SSHDs)), hard disk drives (HDDs), magnetic or optical disc drives. Similar components to those previously described (processor 112 and/or memory 114) can be included in various other vehicle system modules (VSMs) that typically include such processing/storing capabilities.

Some or all of the different vehicle electronics may be connected for communication with each other via one or more communication busses, such as bus 116. Communications bus 116 provides the vehicle electronics with network connections using one or more network protocols. Examples of suitable network connections include a controller area network (CAN), a media oriented system transfer (MOST), a local interconnection network (LIN), a local area network (LAN), and other appropriate connections such as Ethernet or others that conform with known ISO, SAE and IEEE standards and specifications, to name but a few. In other embodiments, each of the VSMs can communicate using a wireless network and can include suitable hardware, such as short-range wireless communications (SRWC) circuitry.

The vehicle 12 can include numerous vehicle system modules (VSMs) as part of the vehicle electronics, such as the camshaft assembly 20 and its various components such as position actuators 48, 50 and position sensors 52, 54, controller 110, a GNSS receiver 118, movement sensor(s) 120, vehicle-user interfaces 122-128, and wireless communication device 130, as will be described in detail below. The vehicle 12 can also include other VSMs 132 in the form of electronic hardware components that are located throughout the vehicle and, which may receive input from one or more sensors and use the sensed input to perform diagnostic, monitoring, control, reporting, and/or other functions. Each of the VSMs 132 is connected by communications bus 116 to the other VSMs, as well as to the wireless communications device 130. One or more VSMs 132 may periodically or occasionally have their software or firmware updated and, in some embodiments, such vehicle updates may be over the air (OTA) updates that are received from a computer 134 or backend facility 136 via network 138 and communications device 130. As is appreciated by those skilled in the art, the above-mentioned VSMs are only examples of some of the modules that may be used in vehicle 12, as numerous others are also possible.

Global navigation satellite system (GNSS) receiver 118 receives radio signals from a constellation of GNSS satellites 140. The GNSS receiver 118 can be configured for use with various GNSS implementations, including global positioning system (GPS) for the United States, BeiDou Navigation Satellite System (BDS) for China, Global Navigation Satellite System (GLONASS) for Russia, Galileo for the European Union, and various other navigation satellite systems. For example, the GNSS receiver 118 may be a GPS receiver, which may receive GPS signals from a constellation of GPS satellites 140. The GNSS receiver 118 can include at least one processor and memory, including a non-transitory computer readable memory storing instructions (software) that are accessible by the processor for carrying out the processing performed by the receiver 118.

GNSS receiver 118 may be used to provide navigation and other position-related services to the vehicle operator. Navigation information can be presented on the display 122 or can be presented verbally such as is done when supplying turn-by-turn navigation. The navigation services can be provided using a dedicated in-vehicle navigation module (which can be part of GNSS receiver 118 and/or incorporated as a part of wireless communications device 130 or other VSM), or some or all navigation services can be done via the vehicle communications device 130 (or other telematics-enabled device) installed in the vehicle, wherein the position or location information is sent to a remote location for purposes of providing the vehicle with navigation maps, altitude, road gradient information, and the like. The position information can be supplied to the vehicle backend facility 136 or other remote computer system, such as computer 134, for other purposes, such as fleet management and/or for use in the camshaft operation methods discussed below. Also, new or updated map data, such as geographical roadway map data stored on databases, can be downloaded to the GNSS receiver 118 from the backend facility 136 via vehicle communications device 130.

The vehicle 12 includes various onboard vehicle sensors 52, 54 of the camshaft assembly 20, as well as movement sensor(s) 120. Also, certain vehicle-user interfaces 122-128 can be utilized as onboard vehicle sensors. Generally, the sensors 52, 54, 120 can obtain information pertaining to engine operation of the vehicle 12. The sensor information can be sent to other VSMs, such as controller 110 and/or the vehicle communications device 130, via communications bus 116. Also, in some embodiments, the sensor data can be sent with metadata, which can include data identifying the sensor (or type of sensor) that captured the sensor data, a timestamp (or other time indicator), and/or other data that pertains to the sensor data, but that does not make up the sensor data itself.

The movement sensors 120 can be used in some implementations to obtain movement and/or inertial information concerning the vehicle 12, such as vehicle speed, acceleration, yaw (and yaw rate), pitch, roll, and various other attributes of the vehicle concerning its movement as measured locally through use of onboard vehicle sensors. The movement sensors 120 can be mounted on the vehicle in a variety of locations, such as within an interior vehicle cabin, on a front or back bumper of the vehicle, and/or on the hood of the vehicle 12. The movement sensors 120 can be coupled to various other VSMs directly or via communications bus 116. The movement sensors 120 may also include various cameras mounted on the vehicle 12, such as a rear trailer camera. Movement sensor data can be obtained and sent to the other VSMs, controller 110 and/or wireless communications device 130. Additionally, the vehicle 12 can include other sensors not mentioned above, including various engine temperature sensors, a mass airflow sensor, a V2V communication unit, a throttle position sensor, etc.

The vehicle electronics also includes a number of vehicle-user interfaces that provide vehicle occupants with a means of providing and/or receiving information, including visual display 122, pushbutton(s) 124, microphone 126, and audio system 128. As used herein, the term "vehicle-user interface" broadly includes any suitable form of electronic device, including both hardware and software components, which is located on the vehicle and enables a vehicle user to communicate with or through a component of the vehicle. Vehicle-user interfaces 122-128 are also onboard vehicle sensors that can receive input from a user or other sensory information. The pushbutton(s) 124 allow manual user input into the communications device 130 to provide other data, response, or control input. Audio system 128 provides audio output to a vehicle occupant and can be a dedicated, stand-alone system or part of the primary vehicle audio system. According to the particular embodiment shown here, audio system 128 is operatively coupled to both vehicle bus 116 and an entertainment bus (not shown) and can provide AM, FM and satellite radio, CD, DVD and other multimedia functionality. This functionality can be provided in conjunction with or independent of an infotainment module. Microphone 126 provides audio input to the wireless communications device 130 to enable the driver or other occupant to provide voice commands. For this purpose, it can be connected to an on-board automated voice processing unit utilizing human-machine interface (HMI) technology known in the art. Visual display or touch screen 122 is preferably a graphics display and can be used to provide a multitude of input and output functions. Display 122 can be a touch screen on the instrument panel, a heads-up display reflected off of the windshield, or a projector that can project graphics for viewing by a vehicle occupant. Various other vehicle-user interfaces can also be utilized, as the interfaces of FIG. 1 are only an example of one particular implementation.

A user of the vehicle 12 can use one or more vehicle-user interfaces 122-128, as discussed more below, to activate an engine braking mode and operate the camshaft assembly 20 via the controller 110, to cite a few examples. In one embodiment, the user can operate one or more vehicle-user interfaces 122-128, which can then deliver inputted information to other VSMs, such as the controller 110 or the wireless communications device 130. For example, display 122 may be used to provide a graphical user interface (GUI) for the user to switch to the cam lobe 46 with the brake gas recirculation cam contour 56 given certain conditions.

Figure 4:
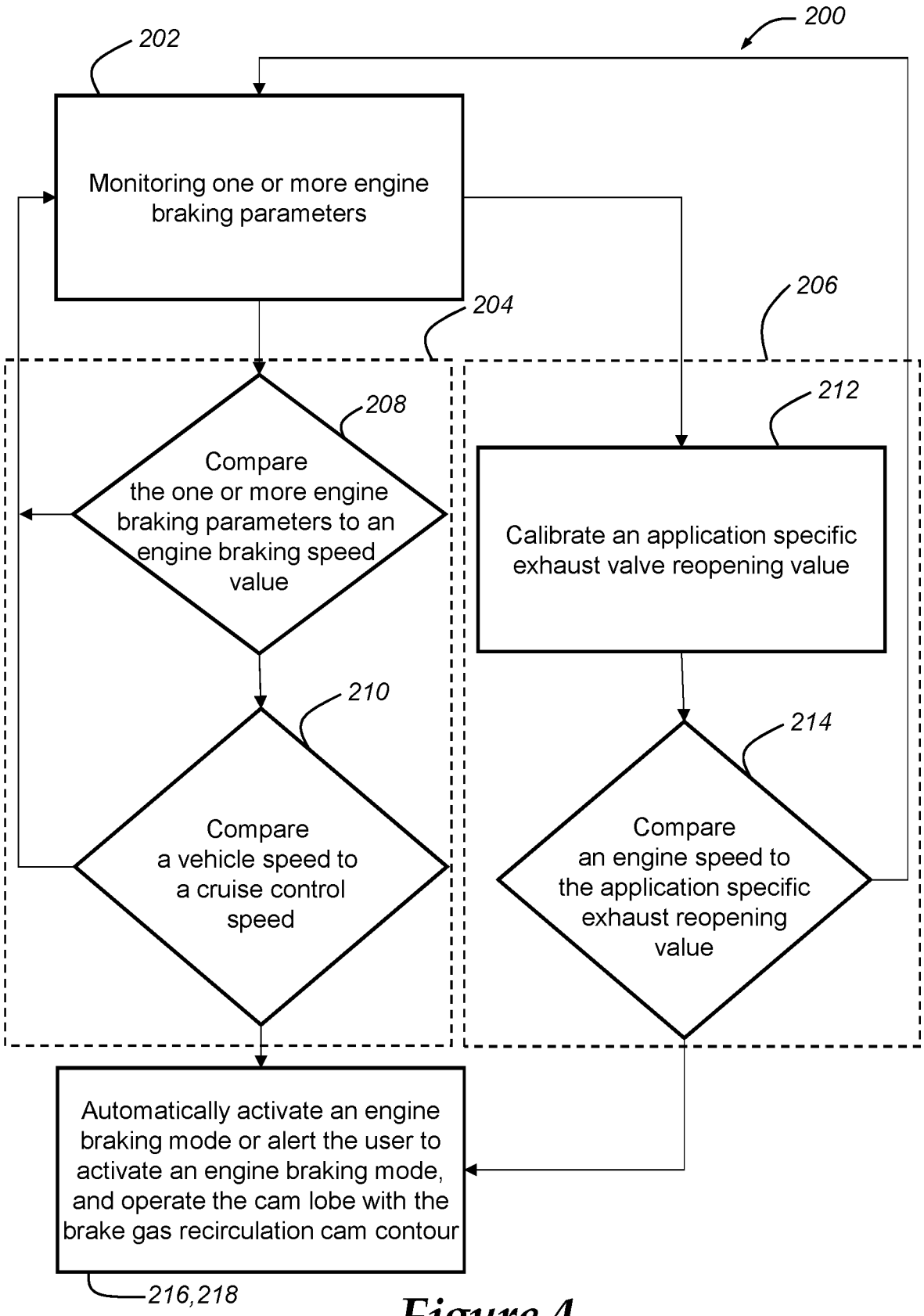
FIG. 4 is a flowchart illustrating an example embodiment of the method of operating the camshaft assembly disclosed herein.

FIG. 4 illustrates a method 200 for operating a camshaft assembly, described with respect to the operating environment 10 of FIG. 1 and camshaft assembly 20 of FIGS. 2 and 3. It should be understood that some or all of the steps of the method 200 could be performed at the same time or in an alternative order than what is described below. Further, it is likely that the method 200 could be implemented in other systems that are different from the systems illustrated in FIGS. 1-3, and that the description of the method 200 within the context of the system 10 and assembly 20 is only an example.

In step 202 of the method, one or more engine braking parameters are monitored. In an advantageous embodiment, the engine braking parameters include an engine speed (RPM) of the internal combustion engine 22. This information may be provided by or otherwise derived from movement sensors 120, or from other input(s) to the ECU or controller 110. In another embodiment, the engine braking parameters also include a vehicle speed of the vehicle 12 and/or a cruise control speed of the vehicle 12. This information may also be provided by or otherwise derived from movement sensors 120, or from other input(s) to the ECU or controller 110. In yet another embodiment, the engine braking parameters include a road load. The road load typically takes into account the gradient of the road on which the vehicle 12 is traveling, the road surface, and/or wind resistance. Information relating to the road load may be derived from the GNSS receiver 118, movement sensors 120 (e.g., a rear trailer camera), and/or from backend facility 136. Monitoring road load may be advantageous in embodiments in which cruise control speed is not used as an input.

The method 200 then has two paths, 204, 206. In the first path 204, step 208 compares the one or more engine braking parameters monitored in step 202 to an engine braking speed value. In one example, the engine braking speed value is an application specific braking value (RPM). The application specific braking value is typically dependent on factors such as engine size, stroke displacement, etc., and is usually an established parameter. According to an embodiment, the application specific braking value is the RPM level in which the motor is run without fuel, or an engine braking speed in which the engine acts as a pump to create braking force (e.g., beyond 3000 RPM, or between 3200-4800 RPM, etc.). In one implementation, step 208 asks whether the engine speed monitored in step 202 is greater than the engine braking speed value (e.g., the application specific braking value). If the engine speed is greater than the engine braking speed values (e.g., the application specific braking value) then the method may continue to later steps. If not, the method may return to step 202 to continue monitoring.

Continuing with the first path 204, the method 200 may then, in some embodiments, compare a vehicle speed to a cruise control speed in step 210. If the vehicle speed is greater than the cruise control speed, the method may continue to later steps. If not, the method may return to step 202 to continue monitoring. Typically, if the vehicle speed is greater than the cruise control speed, there is either too much load or an engine braking mode has not been engaged (e.g., if the cruise control speed is 60 MPH but the vehicle speed is 62 or 63 MPH). Accordingly, step 210 may indicate that an engine braking mode should be activated.

The second path 206 is an alternate (or in some embodiments an additional corroboration to) the first path 204. In step 212, an application specific exhaust valve reopening value is calibrated. This application specific exhaust valve reopening value is an engine braking speed value, and accordingly may be an RPM amount in which uncontrolled opening of the exhaust valve is likely to occur. Analytic data may be combined with real-time data in some embodiments to determine this value. In some embodiments, analytic data relating to cylinder pressures, outlet pressures, exhaust valve spring preload, etc., may be used to ascertain the application specific exhaust valve reopening value. In one particular example, the application specific exhaust valve reopening value is about 4000-4100 RPM.

In step 214, the method compares an engine speed monitored in step 202 to the application specific exhaust reopening value, that may or may not be calibrated in step 212. If the engine speed is greater than the application specific exhaust reopening value, the method may continue to later steps. If not, the method may return to step 202 to continue monitoring. This step may be indicative that an engine braking mode is advantageous as it can help avoid uncontrollable opening of the exhaust valve 28 and can instead enable controlled opening of the exhaust valve.

Step 216 of the method 200 involves switching to the cam lobe 36 with the brake gas recirculation cam contour 56 when the comparison of the one or more engine braking parameters to the engine braking speed value indicates that an engine braking mode is to be activated. This may be accomplished via satisfaction of the criteria in path 204 and/or path 206. The determinations in paths 204, 206, as well as monitoring in step 202, may be accomplished by the controller 110, and accordingly, the controller 110 may facilitate the cam lobe switching in step 216. In one embodiment, the controller 110 sends a signal to the electromagnetic position actuators 48, 50 to switch from a cam lobe 38 with a normal cam contour 58 to the cam lobe 36 with the brake gas recirculation cam contour 56. In one embodiment, the lobe pack 32 is slidably displaced along the camshaft 24 in order to switch cam lobes 36, 38. Additionally, in some embodiments, a cam lobe with a brake gas recirculation cam contour may be used on more than one cylinder of the engine 22. For example, cam lobe 42 of the second lobe pack 34, which has a brake gas recirculation cam contour 62, may be employed along with the cam lobe 36. In other embodiments, possibly depending on the criteria satisfied (e.g., if engine speed is a significant degree higher than the engine braking speed value), both cam lobes 36, 42 can be activated, or only one at a time may be activated. Activation of one or more of the cam lobes 36, 42 may also be considered activation of an engine braking mode. In some embodiments, an alert may be provided to the user (e.g., via a heads-up display 122 or via another vehicle user interface 124-128) that the engine braking mode is activated. Automatic activation of the engine braking mode may help protect engine durability.

In another embodiment of step 216, instead of automatic activation of the engine braking mode via action by controller 110, an alert may be provided to the user of vehicle 12 that an engine braking mode should be activated. Accordingly, the switching step may not take place until input from the user is obtained, e.g., via a vehicle user interface 122-128. Accordingly, after satisfaction of either path 204 or 206 (or both), an alert can be provided to the user that an engine braking mode should be activated. The user of the vehicle 12 can then, for example, push the button 124 to enable switching of the lobe pack 32 to the cam lobe 36 with the brake gas recirculation cam contour 56.

Step 218 of the method 200 involves operation of the cam lobe 36 with the brake gas recirculation cam contour 56 (which is also applicable to other cam lobes having a brake gas recirculation cam contour, if employed). As with the normal cam 38 having a standard cam contour 58, the cam lobe 36 facilitates opening of the exhaust valve 28 of the internal combustion engine 22 with the exhaust stroke projection 68 during the exhaust stroke. However, with the brake gas recirculation cam contour 56, the combustion stroke projection 70 facilitates opening of the exhaust valve 28 of the internal combustion engine 22 during the combustion stroke such that less power is transmitted to the crankshaft, thereby slowing the vehicle 12.

Figure 5:
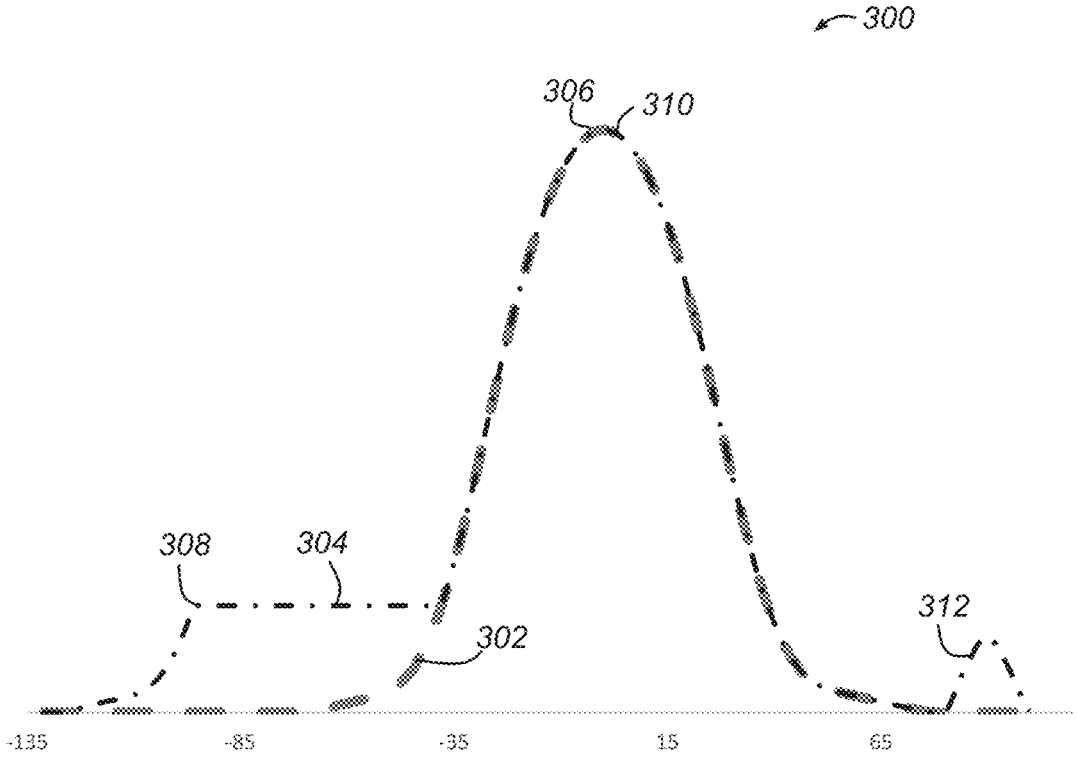
FIG. 5 shows exhaust valve lift profiles for the cam lobe having the brake gas recirculation cam contour of FIG. 3 and a cam lobe without the brake gas recirculation cam contour.

FIG. 5 is a graph 300 illustrating an exhaust valve lift profile 302 for a normal cam contour 58 (gray dashed line) as compared to an exhaust valve lift profile 304 for a brake gas recirculation cam contour 56 (black dot-dash line), with the cam angle being designated on the x-axis. The exhaust valve lift profile 302 for the normal cam contour 58 has a standard single lift 306 for the exhaust stroke. However, with the brake gas recirculation cam contour 56, a first exhaust lift 308 provides an outlet during the combustion stroke for the exhaust gas. Then, a second exhaust lift 310 corresponds to the standard exhaust stroke. Additionally, and unexpectedly, the camshaft assembly 20 and the brake gas recirculation cam contour 56 resulted in a third exhaust lift 312. This unexpected third exhaust lift 312 could possibly be the result of high turbine inlet pressure. The exhaust valve lift profile 304 can improve the effective compression ratio and allow for exhaust gas rebreathing during the intake stroke. In testing of the camshaft assembly 20, at an investigated point of 3900 RPM with a turbine inlet pressure of 5 bar absolute, reopening of the exhaust valve 28 resulted in an increase in braking torque (346 Nm without reopening, as compared to 359 Nm with reopening with the brake gas recirculation cam contour 56). In another example test, switching of the camshaft assembly 20 to the brake gas recirculation cam contour 56 resulted in about 20 Nm of brake torque.

It is to be understood that the foregoing description is not a definition of the invention, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, the specific combination and order of steps is just one possibility, as the present method may include a combination of steps that has fewer, greater or different steps than that shown here. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A camshaft assembly for an internal combustion engine of a vehicle, the camshaft assembly comprising:

an exhaust camshaft;

an exhaust valve lifter; and a lobe pack including a plurality of cam lobes, wherein the lobe pack is configured on the exhaust camshaft such that one or more cam lobes of the plurality of cam lobes are configured to selectively activate the exhaust valve lifter, wherein the one or more cam lobes of the plurality of cam lobes includes a brake gas recirculation cam contour having an exhaust stroke projection and a combustion stroke projection, wherein the combustion stroke projection is configured to increase exhaust outtake during a combustion stroke of the internal combustion engine, wherein the camshaft assembly is configured to switch to at least one of the one or more cam lobes with the brake gas recirculation cam contour when a comparison of one or more engine braking parameters to an engine braking speed value, to an application specific exhaust reopening value, or to both the engine braking speed value and the application specific exhaust reopening value, indicates that an engine braking mode is to be activated.

2. The assembly of claim 1, wherein the lobe pack is a two-step lobe pack having two cam lobes, each cam lobe having a different cam contour.

3. The assembly of claim 2, wherein an exhaust valve lift profile for the brake gas recirculation cam contour includes two more exhaust lifts than an exhaust valve lift profile for a cam lobe without the brake gas recirculation cam contour.

4. The assembly of claim 1, wherein the lobe pack is a three-step lobe pack having three cam lobes, each cam lobe having a different cam contour.

5. The assembly of claim 1, further comprising a second lobe pack including a plurality of cam lobes.

6. The assembly of claim 5, wherein the plurality of cam lobes of the second lobe pack includes a cam lobe having a brake gas recirculation cam contour.

7. The assembly of claim 5, wherein the plurality of cam lobes of the second lobe pack includes cam lobes without a brake gas recirculation cam contour.

8. The assembly of claim 1, wherein the combustion stroke projection and the exhaust stroke projection have different circumferential widths.

9. The assembly of claim 8, wherein the circumferential width of the combustion stroke projection is one-sixth to one-half, inclusive, of the circumferential width of the exhaust stroke projection.

10. The assembly of claim 1, wherein the lobe pack is slidably displaced along the exhaust camshaft via actuation of an electromagnetic actuator.

11. The assembly of claim 1, wherein the internal combustion engine is diesel-powered.

12. A method of operating a camshaft assembly for an internal combustion engine of a vehicle, the camshaft assembly comprising an exhaust camshaft and a lobe pack on the exhaust camshaft, the lobe pack including a plurality of cam lobes, wherein at least one cam lobe of the plurality of cam lobes includes a brake gas recirculation cam contour having an exhaust stroke projection and a combustion stroke projection, the method comprising:

monitoring one or more engine braking parameters;

comparing the one or more engine braking parameters to an engine braking speed value;

switching to one or more cam lobes of the at least one cam lobe including the brake gas recirculation cam contour when the comparison of the one or more engine braking parameters to the engine braking speed value indicates that an engine braking mode is to be activated;

opening an exhaust valve of the internal combustion engine with the exhaust stroke projection during an exhaust stroke of the internal combustion engine; and opening the exhaust valve of the internal combustion engine with the combustion stroke projection during a combustion stroke of the internal combustion engine.

13. The method of claim 12, wherein the one or more engine braking parameters includes an engine speed and the engine braking speed value is an application specific braking value, and switching to the one or more cam lobes of the at least one cam lobe including the brake gas recirculation cam contour when the engine speed is greater than the application specific braking value.

14. The method of claim 13, wherein the one or more engine braking parameters further includes a vehicle speed and a cruise control speed, and switching to the one or more cam lobes of the at least one cam lobe including the brake gas recirculation cam contour when the vehicle speed is greater than the cruise control speed and when the engine speed is greater than the application specific braking value.

15. The method of claim 12, wherein the one or more engine braking parameters includes an engine speed and the engine braking speed value is an application specific exhaust valve reopening value, and switching to the one or more cam lobes of the at least one cam lobe including the brake gas recirculation cam contour when the engine speed is greater than the application specific exhaust valve reopening value.

16. The method of claim 12, further comprising the step of providing an alert to a user of the vehicle when the comparison of the one or more engine braking parameters to the engine braking speed value indicates that the engine braking mode is to be activated before switching to the one or more cam lobes of the at least one cam lobe including the brake gas recirculation contour.

17. The method of claim 12, wherein switching occurs automatically through use of a controller.

18. The method of claim 17, further comprising providing an alert to a user of the vehicle that the engine braking mode is activated.

* * * * *